US007422364B2

(12) United States Patent
Scheufele

(10) Patent No.: US 7,422,364 B2
(45) Date of Patent: Sep. 9, 2008

(54) ZERO-RESETTING DEVICE FOR A TIMEPIECE

(75) Inventor: Karl-Friedrich Scheufele, Prangins (CH)

(73) Assignee: Chopard Manufacture S.A., Fleurier (CH)

( * ) Notice: Subject to any disclaimer, the term of this patent is extended or adjusted under 35 U.S.C. 154(b) by 0 days.

(21) Appl. No.: 11/889,486

(22) Filed: Aug. 14, 2007

(65) Prior Publication Data

US 2008/0043576 A1 Feb. 21, 2008

(30) Foreign Application Priority Data

Aug. 15, 2006 (CH) ..... 1308/06

(51) Int. Cl.
*G04F 7/00* (2006.01)

(52) U.S. Cl. ..... 368/106

(58) Field of Classification Search ..... 368/89, 368/97, 101–106, 112
See application file for complete search history.

(56) References Cited

U.S. PATENT DOCUMENTS 1,089,865 A * 3/1914 Porter ..... 368/103
2,512,088 A * 6/1950 Buchler ..... 368/106
3,430,434 A * 3/1969 Piguet ..... 368/106
3,457,720 A * 7/1969 Bachmann ..... 368/103
3,495,397 A * 2/1970 Dubois ..... 368/106
3,518,826 A * 7/1970 Takashina ..... 368/106

FOREIGN PATENT DOCUMENTS

| | | |
|---|---|---|
| CH | 249 420 | 6/1947 |
| CH | 538 716 | 1/1973 |
| EP | 1 494 097 | 1/2005 |

* cited by examiner

*Primary Examiner*—Vit W Miska
(74) *Attorney, Agent, or Firm*—Bacon & Thomas, PLLC.

(57) ABSTRACT

A zero-resetting device for a timepiece, and more particularly for a chronograph, includes a manual control device (2), a second control device (4) that can be actuated by the manual control device (2), one or several zero-resetting cams (6) and one or several hammers (5) that can be actuated by the second control device (4) so as to cooperate with the zero-resetting cam or cams (6) respectively. The second control device (4) is moveable in translation, and the hammer or hammers (5) are pivotable about a respective pivot or pivots (17) that are independent of the second control device (4), and are hinged to the second control device (4) in order to be able to be pivoted about the pivot or pivots (17) by a translational movement of the second control device (4).

16 Claims, 1 Drawing Sheet

Fig.
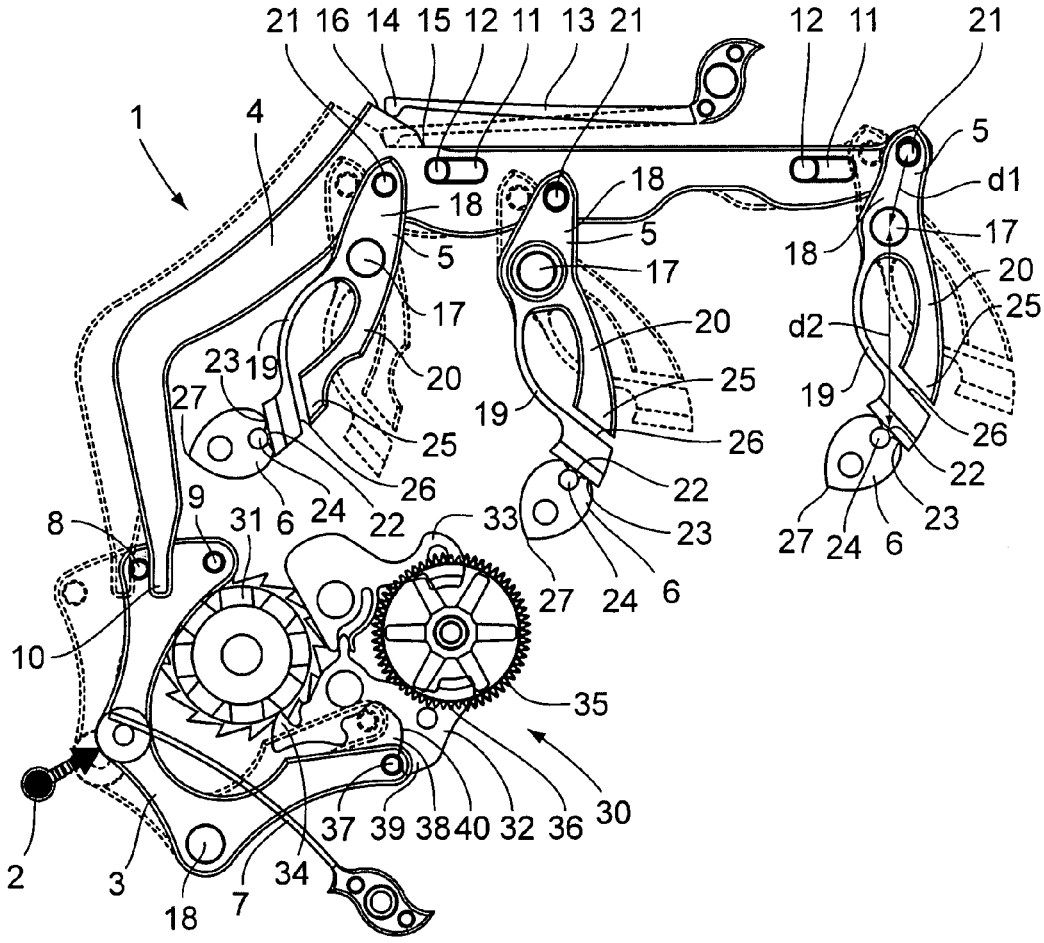

ZERO-RESETTING DEVICE FOR A TIMEPIECE

BACKGROUND OF THE INVENTION

A. Field

The present invention relates to a zero-resetting device for a timepiece and more particularly for a chronograph.

B. Related Art

In conventional chronographs, zero resetting of the hands of the seconds, minutes, and hours counters is brought about through a push-button which, when actuated, sets in motion a monoblock part comprising hammers striking heart-shaped zero-resetting cams mounted on the arbors of the hands.

These zero-resetting devices have several disadvantages. Notably, they are relatively bulky, inasmuch as the excursion of the monoblock part must be sufficiently large for the hammers to be out of the way of the cams when at rest, but pressing against the cams during the zero-resetting operation. Owing to manufacturing tolerances, moreover, the zero resetting of the minutes and/or hours hands generally lacks precision, since the hammers are unable to strike the three cams in a perfectly exact fashion. Finally, the hammers exert a pressure on the zero-resetting cams that can be very high, possibly damaging or even breaking the arbors of the hands.

SUMMARY OF THE INVENTION

The present invention aims at remedying at least in part the disadvantages just cited.

To that end it provides for a zero-resetting device for a timepiece as defined in the appended claim 1, a device for starting, stopping, and zero resetting of a chronograph as defined in claim 9, and a chronograph as defined in claim 13. Particular embodiments of the invention are defined in dependent claims 2 to 8, 10 to 12, and 14.

BRIEF DESCRIPTION OF THE DRAWING

Other characteristics and advantages of the present invention will become apparent from a reading of the following detailed description provided while referring to the appended FIGURE representing a zero-resetting device according to a particular embodiment of the invention.

DETAILED DESCRIPTION OF PREFERRED EMBODIMENTS OF THE INVENTION

Referring to the figure, a zero-resetting device 1 for a chronograph according to the invention comprises a push-button schematically represented at 2 that may be actuated by a user, a lever 3 controlled by push-button 2, a sliding control device 4 controlled by lever 3, pivoting hammers 5 controlled by sliding device 4, and heart-shaped zero-resetting cams 6 that can be actuated by hammers 5.

Depending on the position of push-button 2, lever 3 may take up a position of rest shown as a dotted line, and a zero-resetting position shown as a continuous line. Lever 3 is subject to the action of a return spring 7 opposing the action of push-button 2. At one of its ends, lever 3 comprises two pins 8, 9 between which one end 10 of sliding device 4 is inserted with a certain amount of play. In the position of rest of lever 3, pin 9 abuts against the end 10 of sliding device 4.

Sliding device 4 comprises oblong holes 11 cooperating with fixed guide pins 12 allowing device 4 to slide in translation in the direction of the oblong holes 11 between a position of rest shown as a dotted line, and a zero-resetting position shown as a continuous line. Sliding device 4 is subject to the action of an all-or-nothing spring 13 called zero-resetting jumper. End 14 of this zero-resetting jumper 13 is in abutment in a corner 15 defined by the edge of sliding device 4 when this latter is in its position of rest, but presses against an inclined plane 16 of said edge when sliding device 4 is in its zero-resetting position. In a variant, though, said jumper 13 could be omitted.

In conventional fashion, the zero-resetting cams 6 are heart-shaped, and are mounted on the respective arbors of the chronograph hands, that is, of the hand of the seconds counter, the hand of the minutes counter, and the hand of the hours counter (not represented).

The axes or pivots 17 of hammers 5, like pivot 18 of lever 3 and the pins 12, are mounted on a fixed part of the chronograph, such as the barrel bar. Thus, pivots 17 of hammers 5 are independent of sliding device 4, i.e. they remain fixed in translation while sliding device 4 is displaced in one or the other direction. Each hammer 5 comprises a first arm 18 on one side of its pivot 17, and second and third arms 19, 20 on the other side of its pivot 17. The first and third arms 18, 20 are rigid. The second arm 19 is elastic.

The first arm 18 is hinged by its end to sliding device 4 by means of a pin 21 driven into said end and cooperating with a hole of larger size made in sliding device 4. An inverse arrangement is possible, of course, where pin 21 would be driven into sliding device 4, and would cooperate with a hole of larger size made in arm 18. This hinge connection between the first arm 18 and the sliding device 4 enables the sliding device 4 to cause hammer 5 to pivot about its pivot 17 between a position of rest where hammer 5 is out of the way of the corresponding cam 6, and a zero-resetting position where the hammer's striking face, designated 22, presses against shoulder 23 of cam 6.

The striking face 22 of each hammer 5 that is intended to cooperate with the corresponding cam 6 is defined by the rigid end of second arm 19. In known fashion, said face 22 is inclined relative to the line passing through the corresponding pivots 17, 24 of hammer 5 and cam 6 while hammer 5 and cam 6 are in their zero-resetting positions, with face 22 pressing against shoulder 23 of cam 6.

End 25 of the third arm 20 is free. This end serves as a stop against which face 26 of the end of second arm 19 that is opposite to the striking face 22 will abut in order to limit the bending of second arm 19, particularly in situations where during the zero-resetting motion of hammer 5 the striking face 22 comes in contact with tip 27 of cam 6.

It is preferred that for each hammer 5 the distance or moment arm d1 between pivot 17 and the point of hinging to the sliding device 4, more precisely between the center of pivot 17 and the center of hinge pin 21, be shorter than the distance or moment arm d2 between pivot 17 and the striking face 22, more precisely between the center of pivot 17 and the center of striking face 22.

Besides, zero-resetting device 1 according to the invention cooperates with a vertical coupling device 30 of the chronograph, a device that in a way that is known per se, enables the starting or stopping of the chronograph under the action of a second push-button (not represented) that is distinct from push-button 2. Said coupling device 30 comprises a column wheel 31 that can be actuated by the second push-button, two clamps 32, 33 of which one 32 controls the other 33 and cooperates with column wheel 31 through a beak 34, as well as two superimposed wheels referred to as the lower wheel 35 and upper wheel 36 that are separated by a cone (not represented) with which clamps 32, 33 cooperate, the lower wheel 35 being driven continuously by the chronograph movement, more precisely by the seconds wheel of the movement, and the upper wheel 36 being engaged with a chronograph wheel that is connected with the hands of the seconds, minutes, and hours counters. Clamps 32, 33 are subject to the action of a return spring (not represented), and may take up an open position while beak 34 is in the space between two columns of wheel 31, and a closed position while beak 34 is pressing against one of the columns of wheel 31. In the open position of clamps 32, 33, upper wheel 36 is stationary relative to lower wheel 35, and hence drives the hands of the chronograph. In the closed position of clamps 32, 33, the cone is in an up-position disconnecting upper wheel 36 from lower wheel 35, the chronograph thus being stopped.

In the present invention, clamp 32 comprising beak 34 may be controlled, not only by column wheel 31 but also by lever 3. To this end, an end of lever 3 other than that fitted with the two pins 8, 9 is provided with a third pin 37, while clamp 32 has a recess 38 and a beak 39. In the position of rest of lever 3, pin 37 is in recess 38, close to the wall of said recess, and does not interfere with possible motions of clamps 32, 33 controlled by column wheel 31. When push-button 2 is actuated, pin 37 cooperates in succession with a segment 40 of the wall of recess 38 and with the beak 39, so as to progressively close clamps 32, 33, or directly cooperates with beak 39, so as to keep clamps 32, 33 closed, depending on the position of beak 34 relative to column wheel 31.

Zero resetting by the device according to the invention occurs as follows. When pushed by the user, push-button 2 causes lever 3 to pivot from its position of rest (dotted lines) to its zero-resetting position (continuous lines). During a first part of the excursion of lever 3, sliding device 4 remains in its position of rest on account of the play that exists between pin 8 and the end 10 of sliding device 4, while pin 37 of lever 3 slides over the part of wall 40 of recess 38 of clamp 32 so as to progressively close clamps 32, 33 if they are not already closed by the cooperation between beak 34 and column wheel 31, thus stopping the chronograph. Starting from the point in time where pin 8 comes into contact with the end 10 of sliding device 4, a second part of the excursion of lever 3 begins where pin 8 pushes sliding device 4 into a direction such that hammers 5 will pivot toward cams 6 from their positions of rest that are shown in dotted lines. However, this second part of the excursion of lever 3 will only take place when a certain force is exerted on push-button 2, viz., a force that is large enough for the effect of the zero-resetting jumper 13 to be overcome. Once the effect of said jumper 13 has been overcome, hammers 5 will strike cams 6 straightforwardly and make them rotate until the striking faces 22 of hammers 5 push against shoulders 23 of cams 6, as shown in continuous lines. Pin 37 at the same time holds clamps 32, 33 closed while continuing to slide along the wall of recess 38 until arriving at beak 39. In the final position where the striking faces 22 of hammers 5 are pushing against shoulders 23 of cams 6, and pin 37 is pushing against beak 39, the chronograph hands are at zero. When push-button 2 is released, lever 3 is returned to its position of rest by its return spring 7. During this motion, pin 37 returns to its initial position in recess 38, which automatically restarts the chronograph, or allows its restarting by means of the second push-button, depending on the position of beak 34 relative to column wheel 31, and pin 9 of lever 3 pushes end 10 of sliding device 4 so as to return sliding device 4, and with it hammers 5, into their positions of rest.

It will be noted that by virtue of its sliding control device 4 that causes hammers 5 to pivot about their pivots 17, the zero-resetting device according to the invention offers great flexibility in selecting the arrangement of the different elements, and notably of hammers 5, thus facilitating its integration into a movement or additional mechanism, and allows the overall dimensions to be reduced. The dimensions of the zero-resetting device according to the invention may more particularly be reduced in a significant fashion by adapting the moment arms of hammers 5, viz., by selecting a moment arm d1 that is smaller than the moment arm d2, as in the example illustrated. In this way, actually, a small excursion of sliding device 4 will suffice for obtaining an excursion of the striking faces 22 of hammers 5 that is large enough for said faces 22 to be out of the way of cams 6 in the positions of rest of hammers 5.

Besides, manufacturing imprecisions are compensated by the elasticity of arms 19 of hammers 5, an elasticity that allows the three hands to be precisely reset to zero. This elasticity of arms 19 also serves to lower the strain to which arbors 24 of the hands are subjected while being reset to zero.

By stopping the hands of the chronograph prior to resetting them to zero, finally, the device according to the invention makes possible a precise restarting of said hands after their zero reset, avoiding that the seconds wheel of the movement recoils during zero reset by making up for the play of the gears under the effect of friction of the coupling 30, a recoil that would cause the seconds hand of the chronograph to make a jump forward after the zero reset.

While the present invention is particularly applicable to the zero resetting of chronograph hands, it is not limited to such an application. The present invention may in fact be applied in all timepieces where one wishes to be able to reset one or several hands back to zero.

The invention claimed is:

1. Zero-resetting device for a timepiece comprising a manual control device, a second control device which may be actuated by the manual control device, one or several zero-resetting cams and one or several hammers which may be actuated by the second control device so as to cooperate with the zero-resetting cam or cams, respectively, wherein the second control device is movable in translation, and the hammer or hammers are pivotable about a respective pivot or pivots that are independent of the second control device (4), and are hinged to the second control device so that they may be pivoted about said pivot or pivots by a translational movement of the second control device.

2. Zero-resetting device according to claim 1, including several zero-resetting cams and several respective hammers.

3. Zero-resetting device according to claim 1, wherein the cam or cams are heart-shaped.

4. Zero-resetting device according to claim 1, wherein the manual control device is a push-button.

5. Zero-resetting device according to claim 1, wherein, for the hammer or each hammer, the distance (d1) between the point of hinging to the second control device and the pivot is shorter than the distance (d2) between the face that is intended to cooperate with the corresponding cam and the pivot.

6. Zero-resetting device according to claim 1, wherein the hammer or each hammer comprises an elastic arm one end of which defines a face of the hammer that is intended to cooperate with the corresponding cam.

7. Zero-resetting device according to claim 6, wherein the hammer or each hammer comprises another arm that is rigid, said one end of the elastic arm being able to rest against another end of said other arm in order to limit the deformation of the elastic arm while the hammer cooperates with the corresponding cam.

8. Zero-resetting device according to claim 1, including an intermediate control device intermediate between the manual control device and the second control device.

9. Device for starting, stopping, and zero resetting of a chronograph, comprising a coupling device and a zero-resetting device according to claim 8, the intermediate control device of the zero-resetting device being adapted to control the coupling device so as to stop the chronograph, over a first segment of its excursion, and to control a translational displacement of the second control device for actuating the hammer or hammers, over a second segment of its excursion that follows the first segment.

10. Device according to claim 9, wherein the coupling device is a vertical coupling device comprising clamps, and the intermediate control device is adapted to control closing of the clamps over the first segment of its excursion.

11. Device according to claim 10, wherein the intermediate control device comprises, at a first end, first and second pins between which one end of the second control device is inserted with play, and, at a second end, a third pin cooperating with one of the clamps that controls the other.

12. Device according to claim 8, wherein the intermediate control device is a lever.

13. Chronograph comprising a device according to claim 1.

14. Chronograph according to claim 13, wherein the zero-resetting cam or cams comprise cams for zero-resetting a seconds counter hand, a minutes counter hand, and an hours counter hand.

15. Chronograph comprising a device according to claim 9.

16. Chronograph according to claim 15, wherein the zero-resetting cam or cams comprise cams for zero-resetting a seconds counter hand, a minutes counter hand, and an hours counter hand.

* * * * *